US007448570B2

(12) United States Patent
Böhnisch

(10) Patent No.: US 7,448,570 B2
(45) Date of Patent: Nov. 11, 2008

(54) UNWINDING APPARATUS FOR REELING OFF COILED MATERIAL

(76) Inventor: Rudolf Böhnisch, Auf der Hardt 27, 58540 Meinerzhagen (DE)

( * ) Notice: Subject to any disclaimer, the term of this patent is extended or adjusted under 35 U.S.C. 154(b) by 0 days.

(21) Appl. No.: 11/096,444

(22) Filed: Apr. 1, 2005

(65) Prior Publication Data

US 2005/0253015 A1 Nov. 17, 2005

(30) Foreign Application Priority Data

Apr. 5, 2004 (DE) ..... 10 2004 016 658

(51) Int. Cl.
*B65H 75/24* (2006.01)

(52) U.S. Cl. ..... 242/578; 242/557

(58) Field of Classification Search ..... 242/557, 242/577, 577.4, 578, 593, 597, 597.7, 597.8, 242/401, 407.1, 128, 129, 599.1, 578.2, 607.1, 242/607.2, 577.1, 577.2, 577.3, 578.1, 550; 211/44, 85.5, 78, 163–165, 1.3, 100, 196, 211/205, 107; 248/150, 146, 165, 166
See application file for complete search history.

(56) References Cited

U.S. PATENT DOCUMENTS

| | | | | | |
|---|---|---|---|---|---|
| 30,867 | A | * | 12/1860 | Benedict | 242/577.4 |
| 865,482 | A | * | 9/1907 | Delphey | 242/594.3 |
| 1,542,485 | A | * | 6/1925 | Stevenson | 242/577.4 |
| 2,057,728 | A | | 10/1936 | Lester | |
| 2,300,869 | A | * | 11/1942 | Brandes, Jr. | 242/575.5 |
| 2,463,192 | A | | 3/1949 | Mackey et al. | |
| 2,630,980 | A | | 3/1953 | Weaver | |
| 2,983,465 | A | | 5/1961 | Skubal | |
| 3,058,688 | A | | 10/1962 | Abel | |
| 4,681,277 | A | * | 7/1987 | Kosch | 242/156.2 |
| 4,718,817 | A | | 1/1988 | Maillefer | |
| 4,886,230 | A | * | 12/1989 | Jones et al. | 248/170 |
| 4,949,909 | A | * | 8/1990 | Hatfield | 242/557 |
| 5,100,077 | A | * | 3/1992 | Gagne et al. | 242/129 |
| 6,398,148 | B1 | * | 6/2002 | Snow | 242/395.1 |
| 2001/0008260 | A1 | | 7/2001 | Messier | |

FOREIGN PATENT DOCUMENTS

| | | | |
|---|---|---|---|
| DE | 37 37 418 | C1 | 9/1988 |
| DE | 37 36 677 | C2 | 5/1989 |
| DE | 42 23 635 | A1 | 1/1994 |
| GB | 2 211 907 | A | 7/1989 |
| JP | 05058557 | | 3/1993 |
| JP | 2000-191242 | | 7/2000 |
| JP | 2002087697 | | 3/2002 |
| JP | 2003020164 | | 1/2003 |

* cited by examiner

*Primary Examiner*—Peter M. Cuomo
*Assistant Examiner*—William E Dondero
(74) *Attorney, Agent, or Firm*—Henry M. Feiereisen; Ursula B. Day

(57) ABSTRACT

An unwinding apparatus for reeling off coiled material includes a take-up device for supporting the coiled material. The take-up device has a plurality of spaced-apart arms extending radially in a plane, with at least one of the arms swingably mounted in the plane. Swingably mounted to at least one of the arms is a centering pin so that the centering pin extends in a transport position in parallel relationship to the arm.

14 Claims, 12 Drawing Sheets

UNWINDING APPARATUS FOR REELING OFF COILED MATERIAL

CROSS-REFERENCES TO RELATED APPLICATIONS

This application claims the priority of German Patent Application, Serial No. 10 2004 016 658.7, filed Apr. 5, 2004, pursuant to 35 U.S.C. 119(a)-(d), the subject matter of which is hereby incorporated by reference.

BACKGROUND OF THE INVENTION

The present invention relates to an unwinding apparatus for reeling off coiled material such as cables or annular pipes or similar winding goods, such as plastic tubes (used, e.g., for installation of water pipelines or heating pipelines), that have been wound to annular coils.

Electric cables or pipes, for example for a floor heating system, are oftentimes very long, e.g. of 50 m to 750 m, and thus wound into annular coils. Typically, the coiled material has a hardness that allows elastic bending. Not only because of their extensive length but also because of their great weight, these coils are difficult to handle. Thus, unwinding devices are used for processing the annular coils and are made available in various diameter, height and weight. Unwinding devices typically include a base constructed to resemble a cross or spoke wheel and a coil holding device which is rotatably connected to the base and on which the annular coils are loaded. Clamping elements project from the coil holding device for tensioning and centering the annular coils on the coil holding device.

Unwinding devices with a rotation axis aligned in vertical direction to the standing area as well as winding devices with a rotation axis aligned in horizontal direction (German utility model no. 7830957) have been used. The coils are reeled off from a coil holding device manually, whereby the coiled material rotates in unison with the coil holding device about an axis.

A drawback of prior art unwinding devices is their limited use to accommodate annular coils of different inner and outer diameters, different heights and different weights, and their bulky and heavy construction that requires large spaces for their transport and storage.

As they are paid out, the weight of the annular coils is subjected to centrifugal forces that cause the coil to continue to rotate, even though a stoppage is intended. As a result, the length of unwound material is longer than desired so that a portion of material dangles from the coil holding device and may get entangled in the apparatus. Thus, the subsequent unwinding operation becomes more difficult so that a continuous supervision is required which unnecessarily prolongs the process and renders a desired remote-controlled operation of the unwinding apparatus difficult to implement. Prior art unwinding apparatuses lack also sufficient stability and may tilt so that the coils may get jammed, thereby adversely affecting a further unwinding operation. In a worst case scenario, the unwinding apparatus including the annular coil may even topple over, requiring the operator to intervene, thereby further complicating and prolonging installation of the winding material.

It would therefore be desirable and advantageous to provide an improved unwinding apparatus to obviate prior art shortcomings and to allow universal application while still being easy to transport and reliable in operation.

SUMMARY OF THE INVENTION

According to one aspect of the present invention, an unwinding apparatus for reeling off coiled material includes a coil holding device for supporting the coiled material, with the coil holding device having a plurality of spaced-apart arms extending radially in a plane, with at least one of the arms swingably mounted in the plane, and a centering pin mounted to at least one of the arms for swingable movement of the centering pin to a transport position in which the centering pin extends in parallel relationship to the arm supporting the centering pin.

According to another feature of the present invention, at least one of the arms may have a telescopic construction.

According to another feature of the present invention, the centering pin may be secured to a movable segment of the telescopic arm. The centering pin may be secured to the arm for displacement along the arm.

According to another feature of the present invention, a stand may be rotatably connected to the coil holding device. A connection unit may be provided for rotatably joining the coil holding device with the stand; and a force application unit may apply a radial force and/or an axial force upon the connection unit to slow down a rotation movement of the coil holding device in relation to the stand.

According to another feature of the present invention, the arms may assume the transport position by swinging at least one of the arms for realizing parallel or neighboring disposition of all the arms. Likewise, the stand may have a plurality of radially extending spaced-apart arms which are movable to a transport position by swinging at least one of the arms for assuming a parallel or neighboring disposition of all the arms. The stand may include plural footings which are secured to an underside of the arms of the stand and have a vertical height which is at least as high as the coils wound on coil holding device. The arms of the stand may extend radially in a plane, with at least one of the arms being swingably mounted in the plane. At least one of the arms of the stand may have a telescopic construction.

An unwinding apparatus according to the present invention may be used in operative position by placing the unwinding apparatus at the job site with the arms of the stand upon a placement area, e.g. a floor space. Suitably, the arms of the stand are telescopic to enhance the stability as a consequence of the greater stand diameter. In other words, the arms are extended telescopically and secured in the desired position. Likewise, the arms of the coil holding device are swung out so as to be evenly distributed about a resultant circular area. The arms may have attached thereto centering pins which are movable along the arms and fixable in place and which are swingable in relation to the arms. The centering pins can be suited via their telescopic extensions to the height of the annular coil and can be secured such that the angled ends of the extensions point to the rotation center.

The annular coil is loaded onto the arms of the coil holding device. The centering pins are shifted outwards along the arms of the coil holding device in dependence on the inner coil diameter until resting against the coil and thereby centering the coil in relation to the rotation axis. Thus, the presence of moments caused by the coil weight during the unwinding operation is eliminated. When abutting the coil, the centering pins are fixed in place on the arms of the coil holding device. Advantageously, when great coil diameters are involved, the centering pins are attached to telescopically extendible arms of the coil holding device and swingably mounted in relation to the length axis of the telescopic arms of the coil holding device. In this way, the outer diameter of the coil holding device and the diameter of the centering pin can be expanded and thus suited to almost any coil diameter, when the centering pins are moved outwards along the arms of the coil holding device. The inwardly directed angled extensions of the centering pins are turned outwards and fixed so that the annular coil can be securely restrained from three sides by each arm of the coil holding device in conjunction with the centering pin and extension. The coiled material can now be paid out from the outside to the inside, with an adjustable force acting against the rotation movement.

A transfer of an unwinding apparatus according to the present invention from an operative position to the transport position requires only a swinging of the centering pins in the direction of the arms of the coil holding device until resting thereagainst. The extensions of the centering pins are pushed inwards and turned inwards until the angled end portions of the extensions abut against the arms of the coil holding device and are secured in place.

The swingable arms of the coil holding device and the stand can be pivoted to the respectively fixed arms thereof and their extensions are telescopically moved inside and secured. The arms of the coil holding device and the stand are aligned in coaxial relationship to thereby establish a narrow, compact configuration that can easily be transported and stored. The brake unit is activated to restrain the coil holding device against rotation relative to the stand during transport. The connection unit, constructed as tube, can be used as handle, if need be.

The present invention resolves prior art shortcomings by constructing an unwinding device which is flexible and can be suited to the annular coil at hand and which can easily be converted from an operative position, in which the arms of the coil holding device and stand are extended and appropriately positioned, to a transport and storage position, in which the unwinding apparatus is compact.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
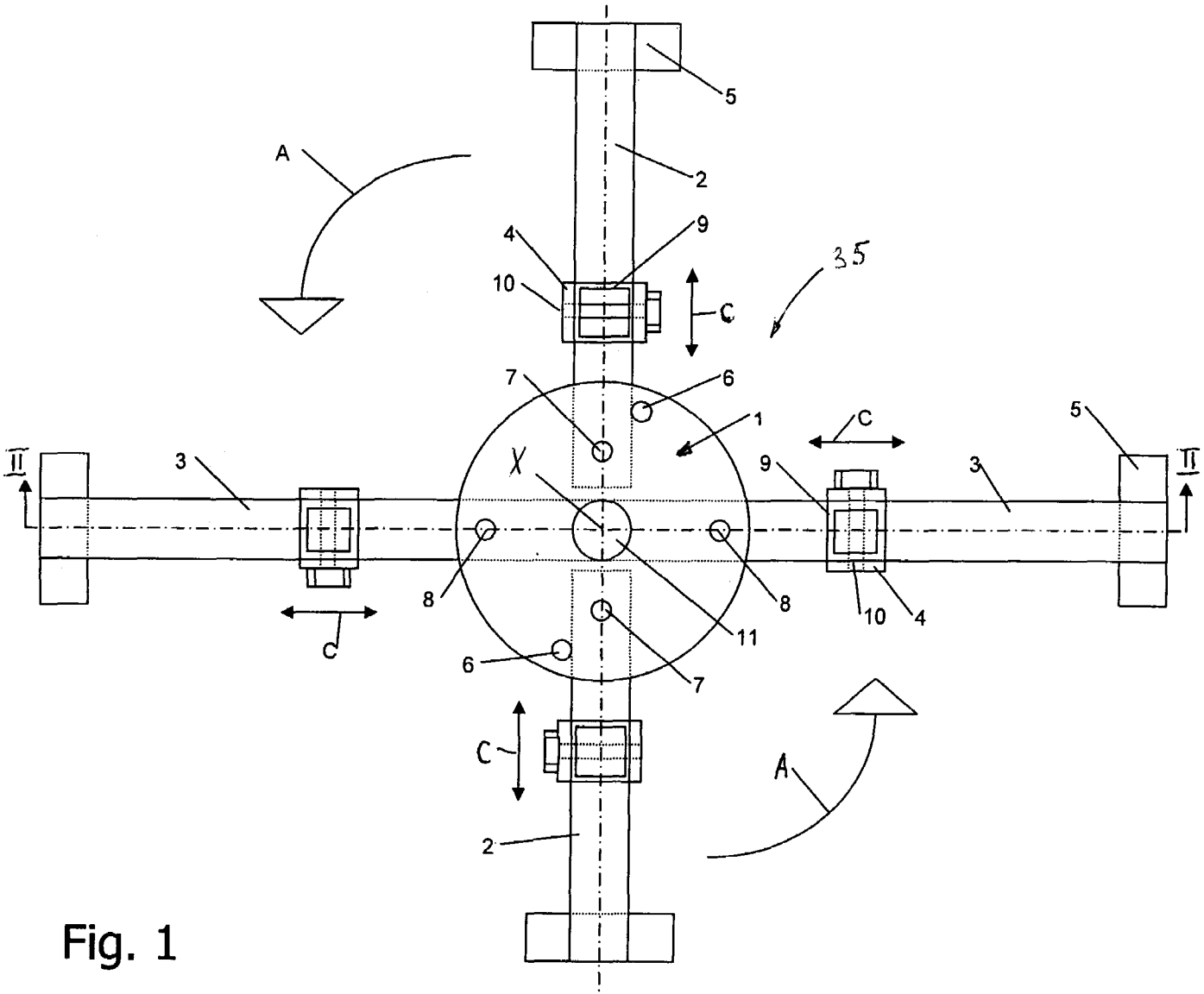
FIG. 1 is a schematic plan view of one embodiment of an unwinding apparatus according to the present invention in operative position and horizontal relationship to a standing area.

Throughout all the Figures, same or corresponding elements are generally indicated by same reference numerals. These depicted embodiments are to be understood as illustrative of the invention and not as limiting in any way. It should also be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a schematic plan view of one embodiment of an unwinding apparatus according to the present invention, including a coil holding device, generally designated by reference numeral 35 and provided for paying out by hand coiled material 39 in the form of annular coils 38, as the coil holding device 35 rotates about a rotation axis X. The coil holding device 35 includes a hub 1 in the form of two parallel mounting disks 12 (FIG. 2) which extend in vertically spaced-apart disposition and are interconnected by bolts 8. Extending radially outwards from the hub 1 is a first pair of opposite arms 2 and a second pair of opposite arms 3 for providing a support surface for the coiled material 39. The arms 3 are hereby fixed in place by the bolts 8 between the disks 12, whereas the arms 2 are secured by bolts 7 for movement between an operative position, as shown in FIG. 1 and a transport position, as shown in FIG. 3, in which the arms 2 are pivoted inwards into parallel relationship to the arms 3, as shown by arrows A. Thus, only two manipulations are necessary to swing the arms 2 from the operative position to the transport position, or vice versa. As indicated in FIG. 1, the arms 3 may be constructed in single-piece configuration with a continuous arm extending end to end to enhance strength and simplify manufacture.

The swinging motion of the arms 2 in one plane toward the operative position is limited by stops 6 which extend perpendicular to the arms 2 from the hub 1.

Figure 2:
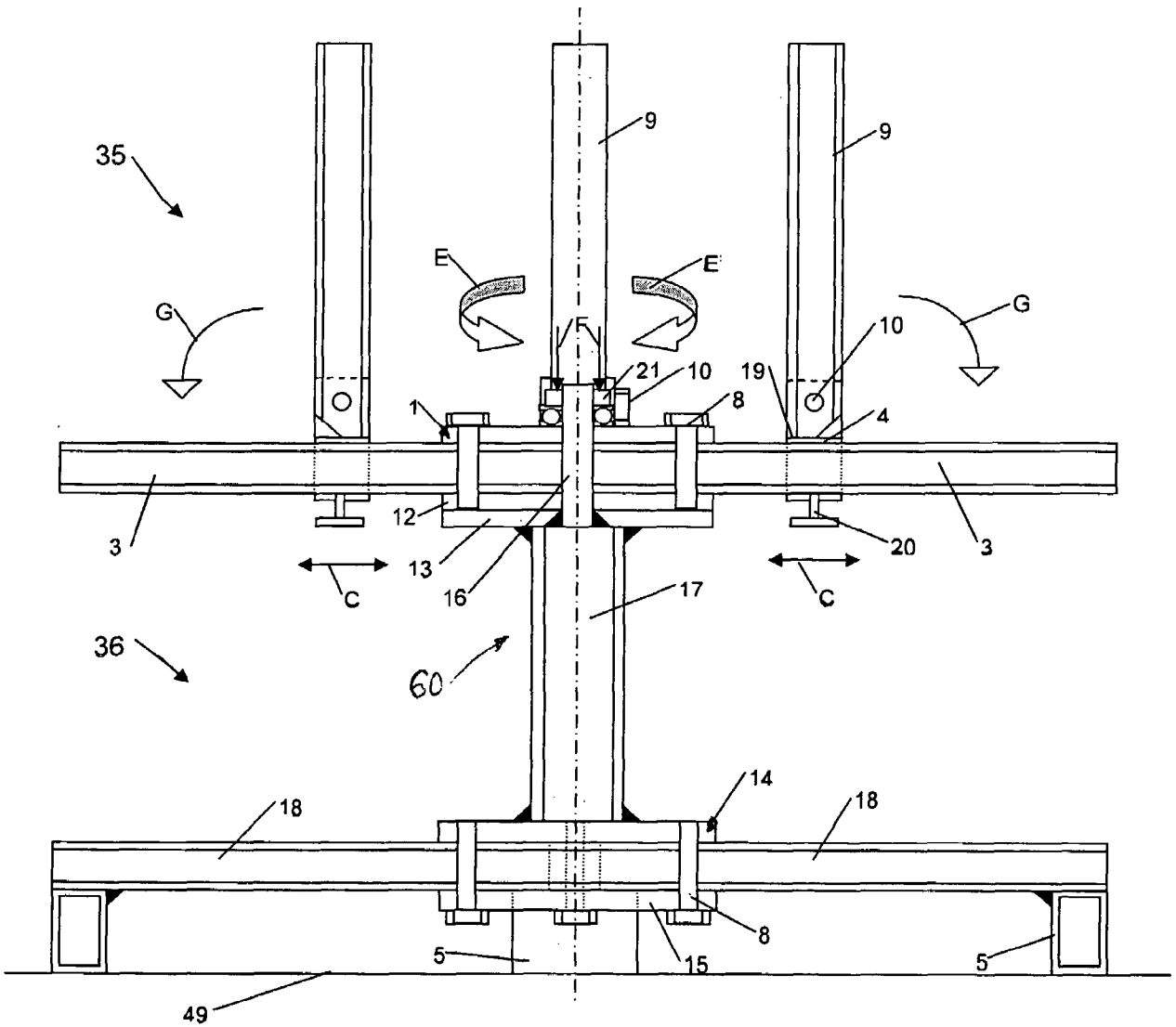
FIG. 2 is a sectional view of the unwinding apparatus, taken along the line II-II in FIG. 1.
Figure 3:
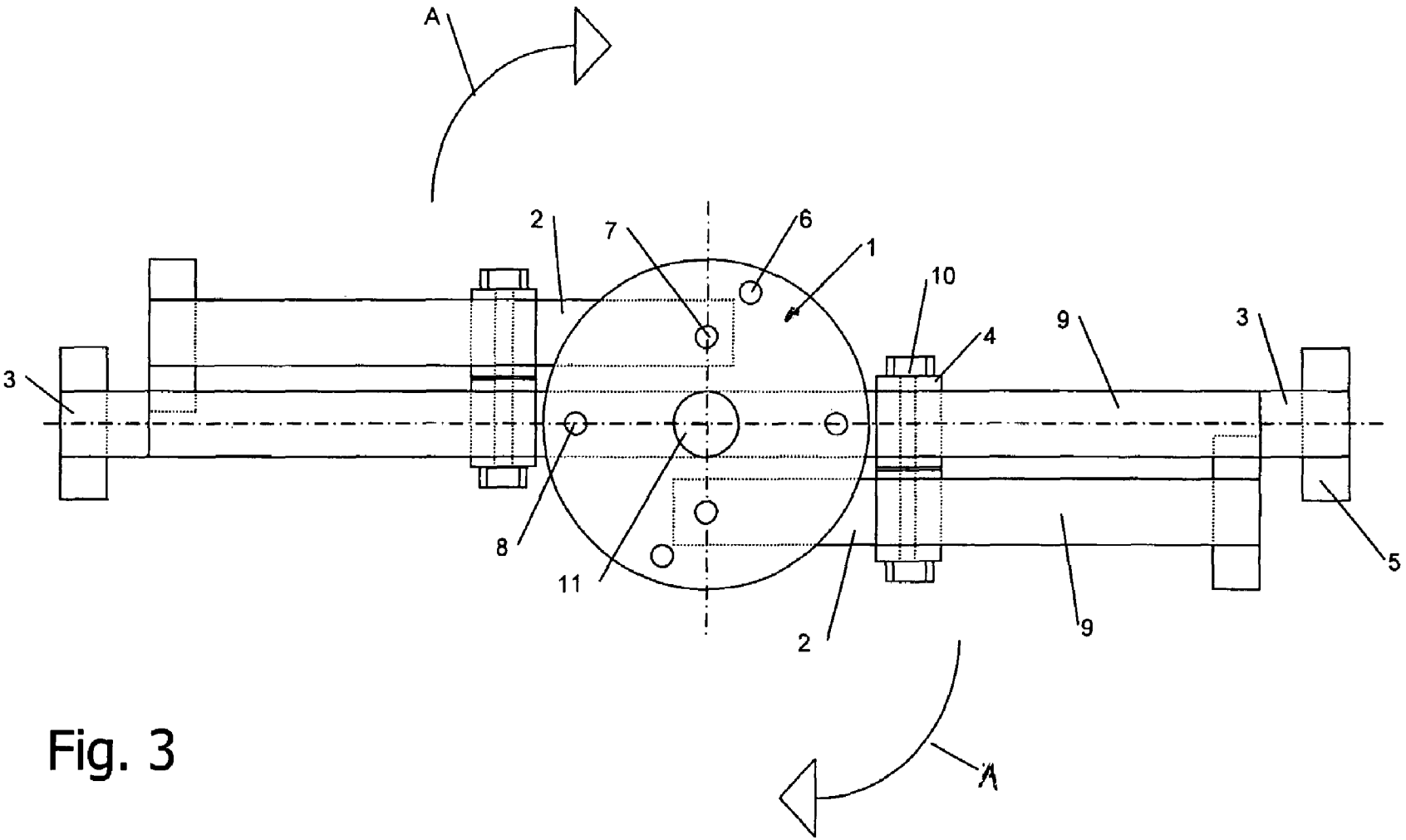
FIG. 3 is a schematic plan view of the unwinding apparatus in transport position.

As shown in particular in FIG. 2, which is a sectional view of the unwinding apparatus, taken along the line II-II in FIG. 1, each of the arms 2, 3 has attached thereto a centering pin 9 which is movable in length direction of the arm, as indicated by double arrow C, and can be fixed in place by a screw fastener 20. The centering pins 9 are received in suitable receptacles 4 and swingably mounted for rotation about bolts 10 in relation to the arms 2, 3, as indicated by arrow G, so that the centering pins 9 can be moved from the operative position, as shown in FIG. 2, in which the centering pins 9 extend perpendicular to the arms 2, 3, to a transport position, as shown in FIG. 3, in which the centering pins 9 extend in substantial parallel relationship to the arms 2, 3. Stops 19 are provided to limit the pivoting motion of the centering pins 9 to the operative position and to maintain the centering pins 9 in the operative position in perpendicular relationship to the arms 2, 3.

As shown in FIG. 2, the coil holding device 35 is aligned in horizontal disposition to a standing area 49 and is rotatably connected by a connection unit, generally designated by reference numeral 60, to a stand, generally designated by reference numeral 36. Like the coil holding device 35, the stand 36 includes a hub 14 in the form of two parallel mounting disks 15 which extend in vertically spaced-apart disposition and are interconnected by bolts 8. Extending radially outwards from the hub 14 is a first pair of opposite arms 18 and a second pair of opposite arms 37, which are not visible in FIG. 2 and extend perpendicular to the arms 18 to define a cross-shaped configuration in the operative position (see, e.g. FIG. 8). The arms 18 are hereby fixed in place through securement of their underside to footings 5, whereas the other opposite arms 37 are swingably movable between the operative position and the transport position, whereby the arms 37 are pivoted inwards in parallel relationship to the arms 18, when assuming the transport position. The footings 5 are constructed as spacers of a height which exceeds a measure "d" (FIG. 10) of the winding material 39 to allow placement of the unwinding apparatus upon a ground surface, which is intended for installation of, for example, a floor heating piping, without damage to the winding material 39, as it is laid.

The connection unit 60 includes a tubular connector 17 which extends centrally between the hubs 1 of the coil holding device 35 and the hub 14 of the stand 36, i.e. centrally to the rotation axis X of the coil holding device 35. The connector 17 has one end joined, e.g. by welding, to a mounting plate 13 which is coextensive to the lower disk 12 of the hub 1. The other opposite end of the connector 17 is joined, e.g. by welding, to the upper disk 15 of the hub 14. Secured, e.g. by welding, to the mounting plate 13 is a pivot 16 (or suitable receptacle for the pivot), which traverses aligned bores 11 in the disks 12 of the hub 1 to thereby establish the rotatable securement of the coil holding device 35 in relation to the stand 36.

The unwinding apparatus according to the present invention is further provided with a braking unit to apply an axial braking force, indicated by arrows F. The braking unit interacts with the connection unit 60 in order to prevent the coiled material 39 from continued unwinding rotation, as indicated by arrows E, when a further unwinding is unwanted and when the diameter Da (FIGS. 9 and 10) of the annular coil 38 progressively decreases. The braking unit includes a clamping unit, e.g. a nut 21, which generates the braking force F and is brought into forced engagement axially via the pivot 16 with the upper disk 12 of the hub 1 of the coil holding device 35.

Figure 4:
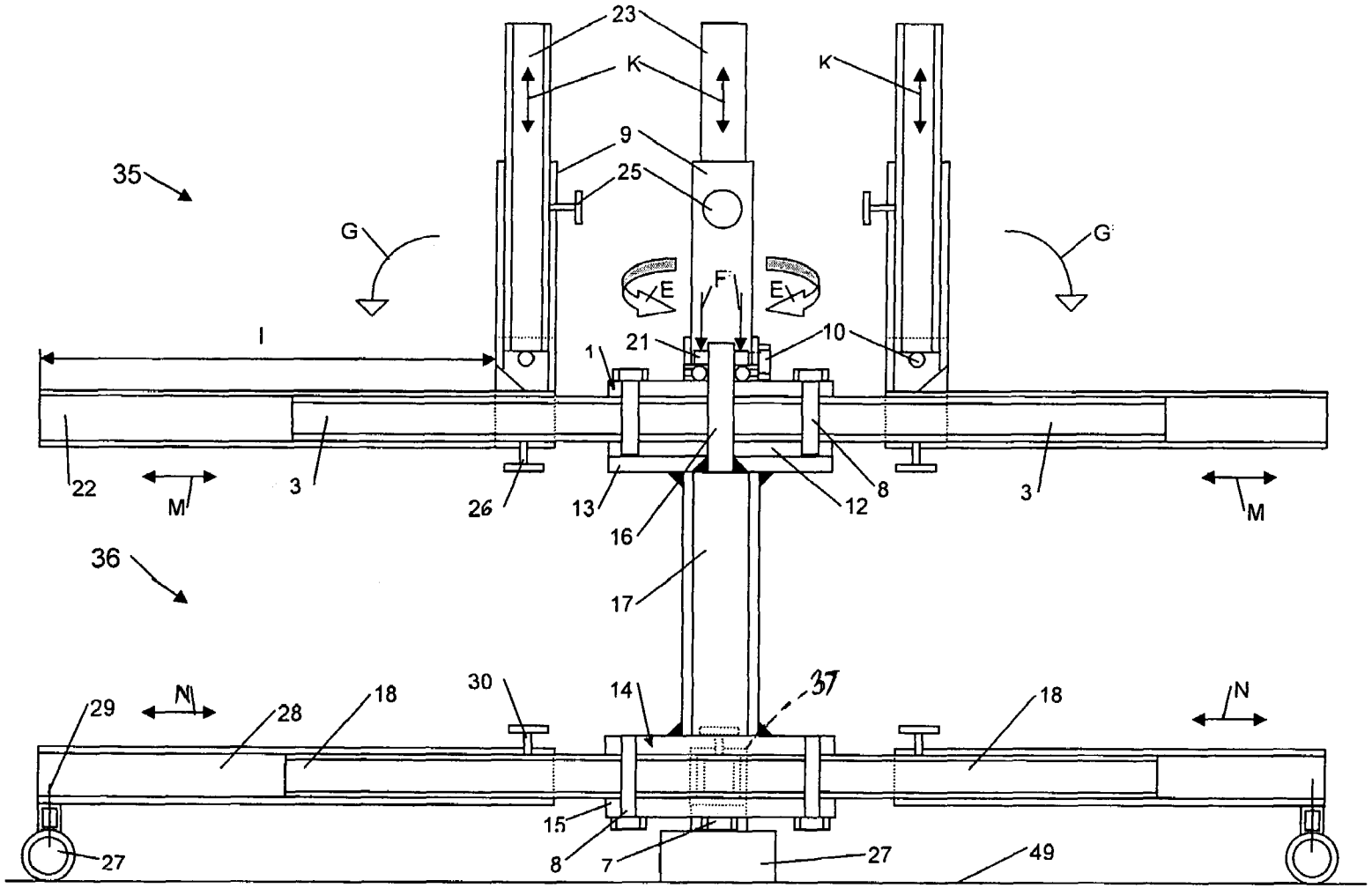
FIG. 4 is a sectional view of another embodiment of an unwinding apparatus according to the present invention in operative position.

Referring now to FIG. 4, there is shown a sectional view of another embodiment of an unwinding apparatus according to the present invention in operative position. Parts corresponding with those in FIGS. 1 to 3 are denoted by identical reference numerals and not explained again. The description below will center on the differences between the embodiments. In this embodiment, the stand 36 has footings 27 in the form of cylinders which are rotatable about a vertical axis 29 and arranged at the axial ends of the arms 18 and the further arms 37, shown here only in phantom lines. The footings 27 are constructed in shape and size like the winding material 39 so that the footings 27 may be secured to the fastening means of the winding material 39 upon the standing area 49 for enhancing stability and preventing damage during the unwinding operation.

As further shown in FIG. 4, the centering pins 9 have a telescopic configuration and include extensions 23 which can be moved in and out, as indicated by double arrows K, in relation to the centering pins 9. Fastening elements 25 are provided to secure the extensions 23 in a desired position along the centering pins 9. In this way, the centering pins 9 can be suited to different heights "h" (FIG. 10) of the coils 38. Likewise, the arms 2, 3 of the coil holding device 35 may be of telescopic construction and thus adjustable in length, whereby their desired position can be secured by fastening elements 26. Accordingly, the arms 2, 3 have each an extension 22 which can be moved in and out in a direction as indicated by double arrow M. When the centering pins 9 are respectively secured at the inner ends of the extensions 22 of the arms 2, 3, the length "l" of the extensions 22 is always longer than a maximum outer diameter Da of the coil 38 so that the winding material 39 is prevented from inadvertently dropping from the take-off device 35 and getting entangled or jammed in the unwinding apparatus. In addition, the unwinding apparatus requires only minimum space in the operative position.

In order to be able to receive coils 38 of very small inner diameter Di, the centering pins 9 can be shifted along the arms 2, 3 almost to the rotation axis X so that a resultant circle 42 (FIG. 11) can then be very small and the centering pins 9 of the coil holding device 35 can be suited to the coil inner diameter Di.

As further shown in FIG. 4, also the arms 18, 37 of the stand 36 may be of telescopic construction and thus adjustable in length, whereby their desired position can be secured by fastening elements 30. Accordingly, the arms 18, 37 have each an extension 28 which can be moved in and out in a direction as indicated by double arrow N. In this way, the stability of the unwinding apparatus is enhanced.

Figure 5:
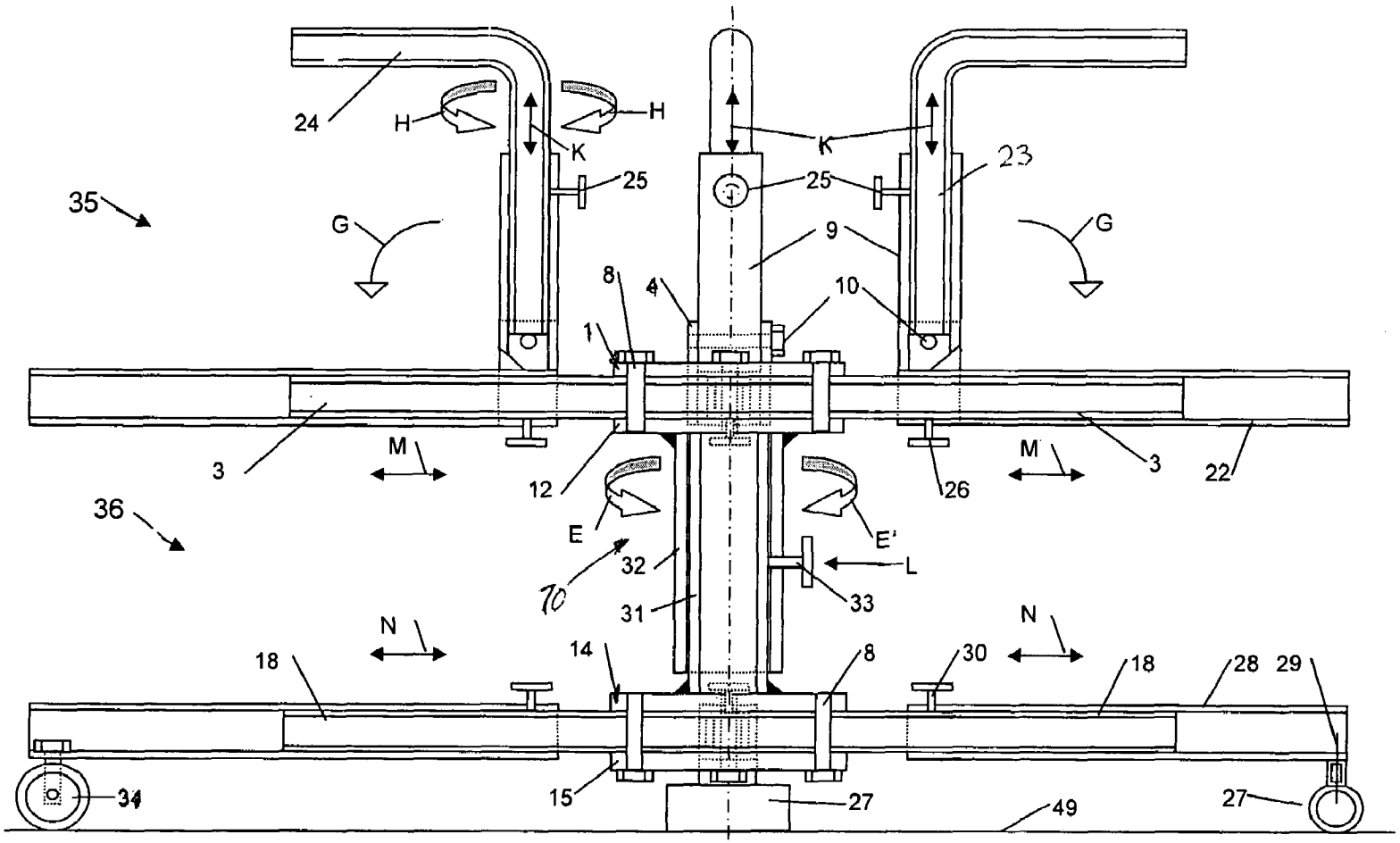
FIG. 5 is a sectional view of yet another embodiment of an unwinding apparatus according to the present invention in operative position.

Referring now to FIG. 5, there is shown a sectional view of yet another embodiment of an unwinding apparatus according to the present invention in operative position. Parts corresponding with those in FIG. 4 are denoted by identical reference numerals and not explained again. The description below will center on the differences between the embodiments. In this embodiment, provision is made for a braking unit for application of a radial braking force, indicated by arrows L. The rotatable connection between the coil holding device 35 and the stand 36, as indicated by arrows E, E', is here realized by a connection unit 70 having two tubes 31, 32 nested within one another at slight play. The tube 31 has a lower end joined, e.g. by welding, to the upper disk 15 of the hub 14 of the stand 36 centrally to the rotation axis X, whereas the tube 32 is joined, e.g. by welding, to the lower disk 12 of the hub 1 of the coil holding device 35 centrally to the rotation axis X. The braking force L is generated by a clamping unit, e.g. a screw 33, which is brought into forced engagement with the inner tube 31 radially via the outer tube 32.

As further shown in FIG. 5, the stand 36 may also be provided with a wheel 34 for facilitating a transport of the unwinding apparatus.

Both connection units 60, 70 allow a rotation clockwise or counterclockwise, as indicated by the arrows E, E' to thereby suit the operation to the purpose of the winding material at hand. Tilting or angling during rotation in directions E, E' is prevented, thereby ensuring a smooth run of the winding apparatus according to the present invention.

As further shown in FIG. 5, the extensions 23 of the centering pins 9 have free angled ends 24 to prevent the winding material 29 from entangling or getting jammed in the centering pins 9 and their extensions 23. Suitably, the ends 24 are rotatably supported so as to allow a rotation in direction of arrows H relative to the centering pins 9. In this way, a change of coils 38 is easier to implement in the operative position.

Figure 6:
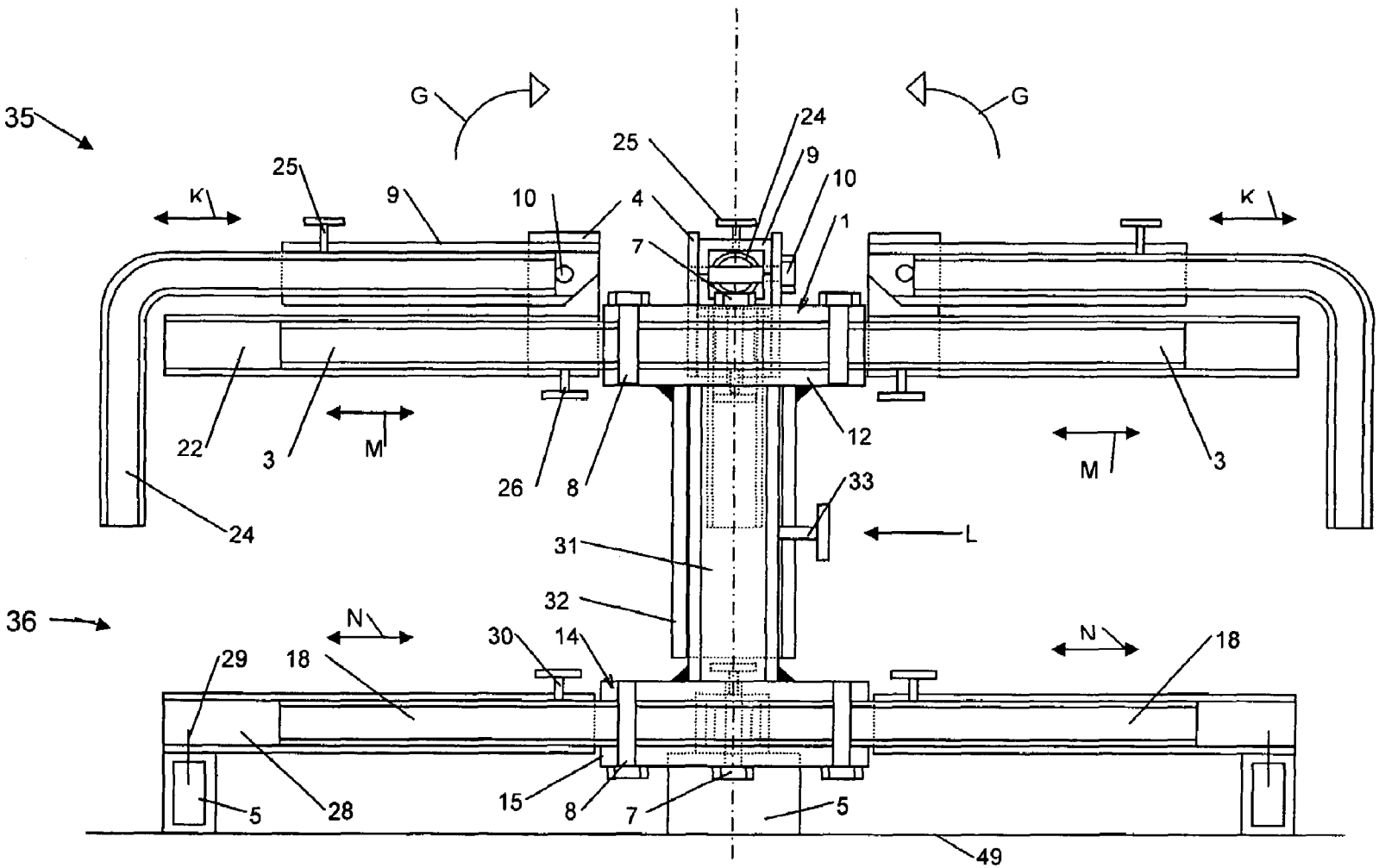
FIG. 6 is a sectional view of a variation of the unwinding apparatus of FIG. 5.

FIG. 6 shows an intermediate position of the unwinding apparatus of FIG. 5 between the operative position and the transport position, whereby the centering pins 9 are pivoted inwards in parallel relationship to the arms 2, 3, with the ends 24 of the extensions 23 pointing inwards and with the extensions 23 moved into the centering pins 9.

Figure 7:
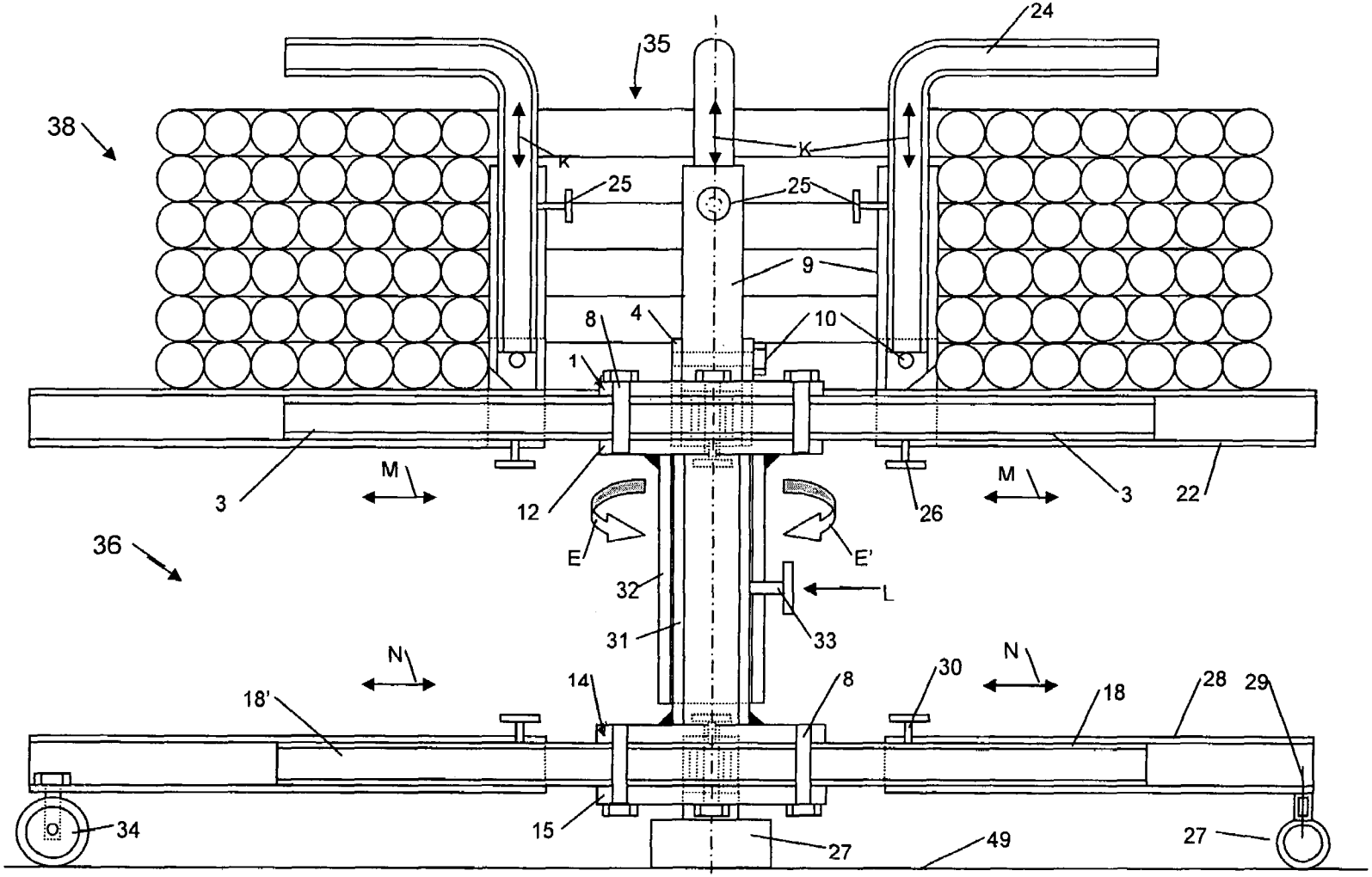
FIG. 7 is a sectional view of the unwinding apparatus of FIG. 5 in operative position with received annular coil.

FIG. 7 is a sectional view of the unwinding apparatus of FIG. 5 in the operative position with an annular coil 38 being loaded onto the coil holding device 35.

Figure 8:
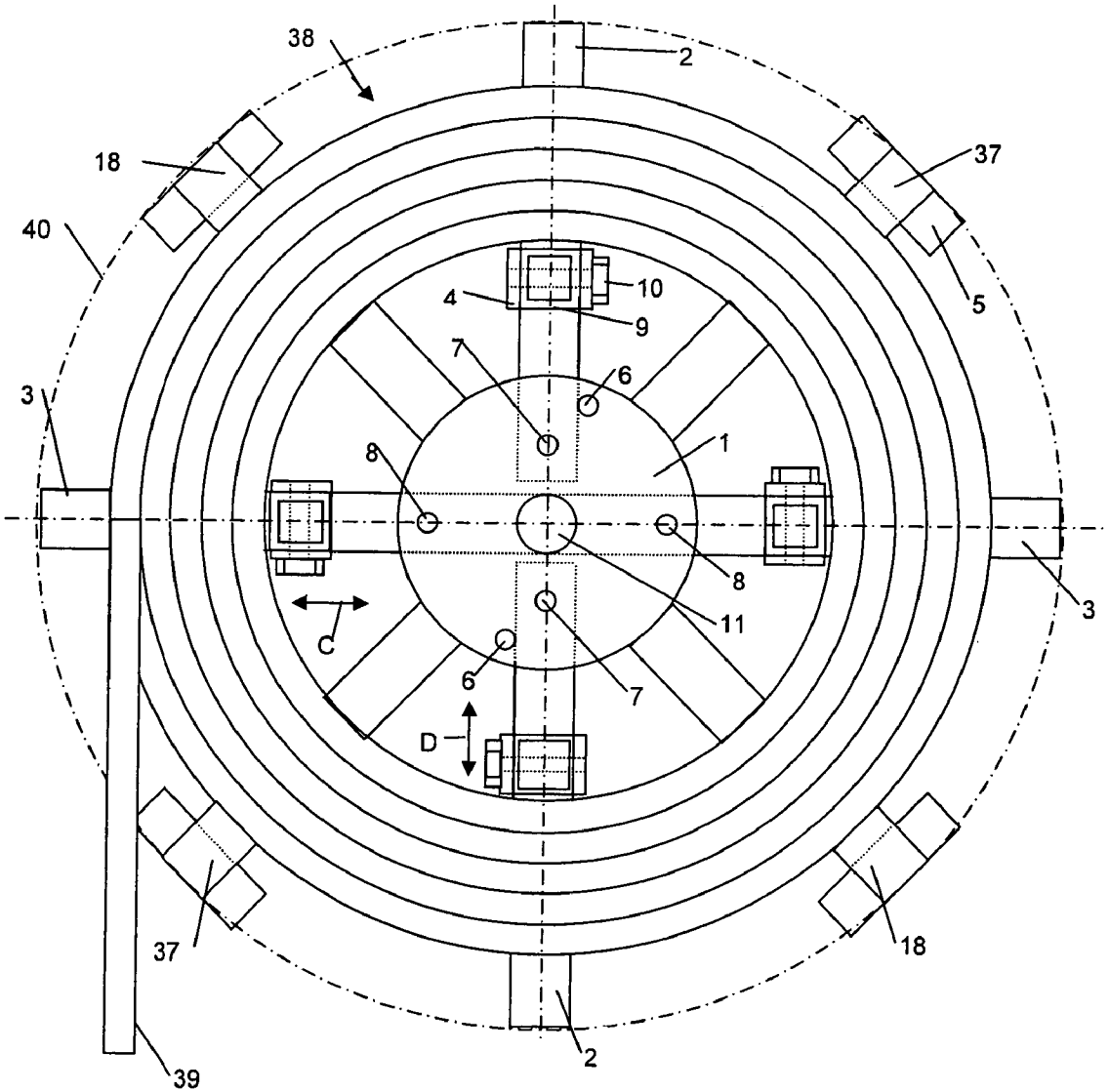
FIG. 8 is a plan view of the unwinding apparatus of FIG. 1, with a 45° rotated disposition of a stand and with a coil holding device having an annular coil loaded thereon.
Figure 10:
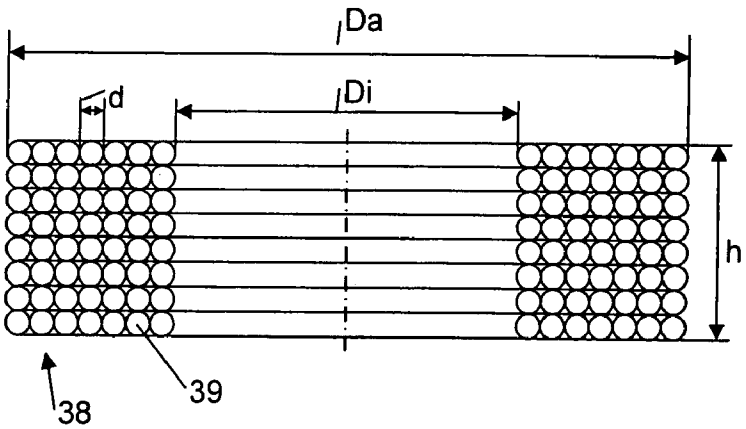
FIG. 10 is a sectional view of the annular coil, taken along the line X-X in FIG. 9.
Figure 9:
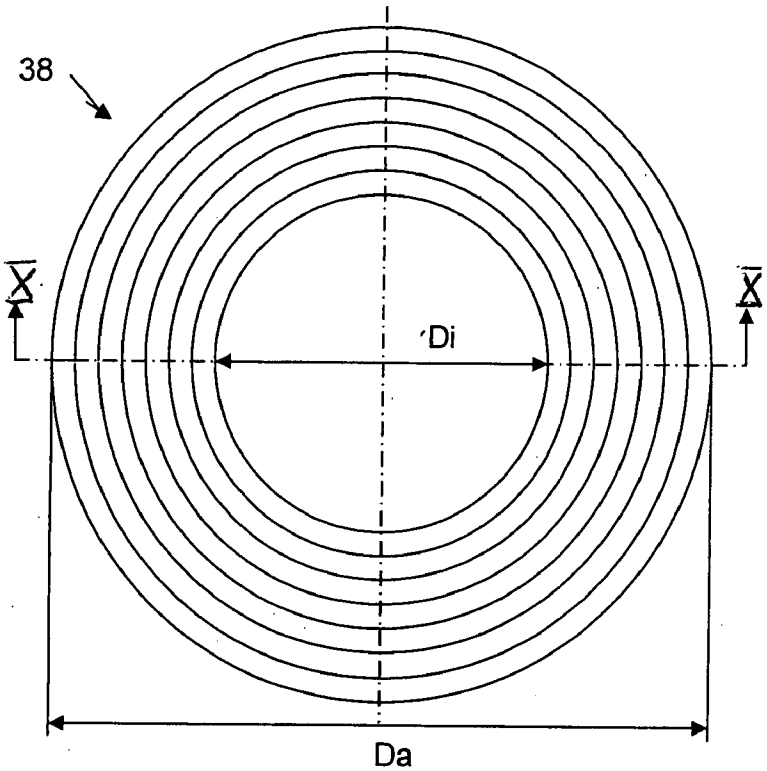
FIG. 9 is a plan view of an exemplary annular coil.

Turning now to FIG. 8, there is shown a plan view of the unwinding apparatus of FIG. 1 in operative position, depicting the stand 36 in a 45° rotated disposition and the coil holding device 35 supporting the coiled material 39. FIGS. 9 and 10 show a plan view and a sectional view, respectively, of the coiled material 39 to form the annular coil 38 on the arms 2, 3 of the coil holding device 35. In the operative position, the arms 2, 3 of the coil holding device 35 and the arms 18, 37 of the stand 36 are evenly distanced about a circular area, indicated by dashed line 40, to thereby realize a stable construction. Thus, as viewed from above, the arrangement of the arms 18, 37 of the stand 36 alternate with the arms 2, 3 of the coil holding device 35.

Figure 11:
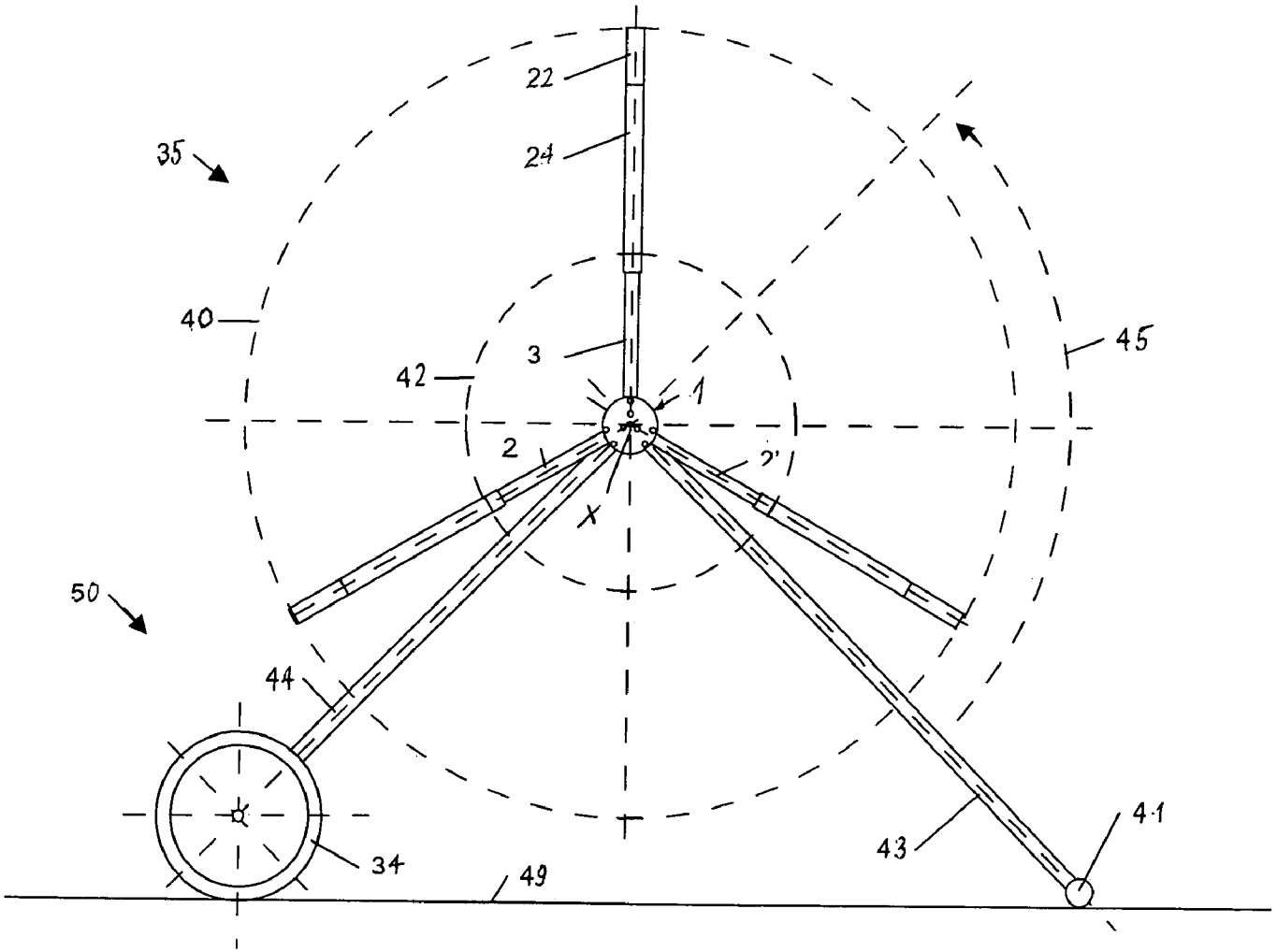
FIG. 11 is a sectional view of still another embodiment of an unwinding apparatus according to the present invention in operative position and vertical relationship to a standing area.
Figure 14:
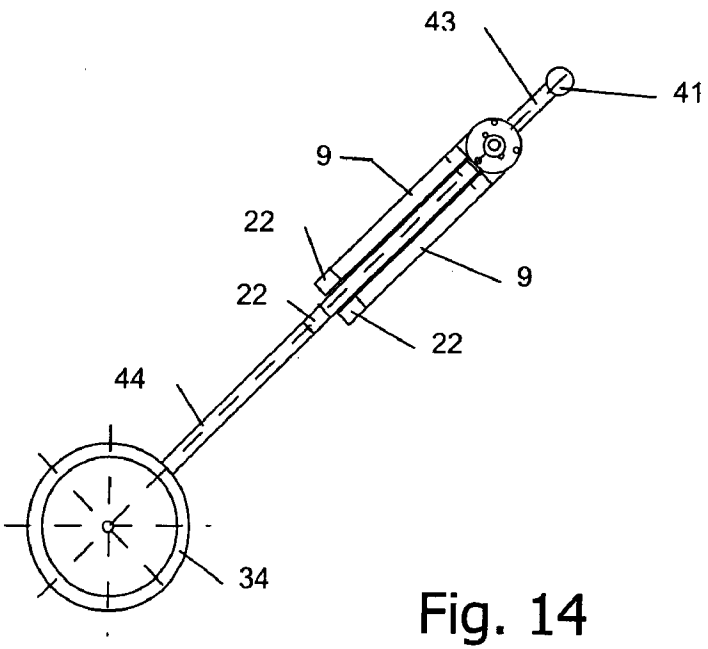
FIG. 14 is a side view of the unwinding apparatus of FIG. 11 in transport position.
Figure 13:
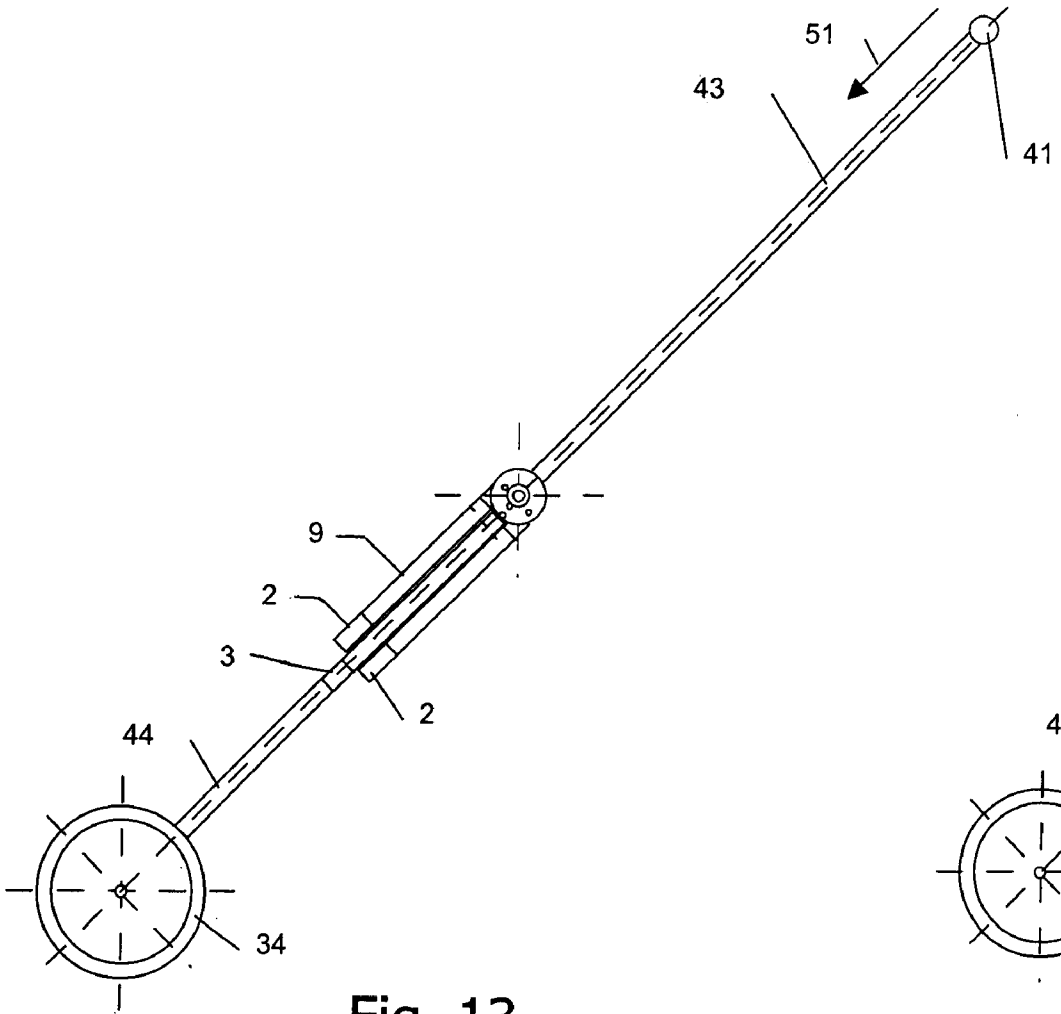
FIG. 13 is a side view of the unwinding apparatus of FIG. 11, in an intermediate position between transport and operative positions.

Referring now to FIG. 11, there is shown a sectional view of still another embodiment of an unwinding apparatus according to the present invention. Parts corresponding with those in FIGS. 1, 2 are denoted by identical reference numerals and not explained again. In this embodiment, the coil holding device 35 is disposed in the operative position in a vertical alignment with respect to the standing area 49 and includes three arms 2, 3 which extend radially outwards from the hub 1 and are spaced evenly at a 120° spaced-apart relationship about the circular area 40. The arms 2, 3 of the coil holding device 35 are swingably mounted. The coil holding device 35 is rotatably supported on a stand, generally designated by reference numeral 50 and having a transport wheel 34 for rolling on the standing area 49 to improve a transport thereof, when the unwinding apparatus is transformed into a collapsed state, as shown in FIGS. 13 and 14. The transport wheel 34 is hereby connected to the hub 1 via a strut 44. A handle 41 is further swingably connected to the hub 1 via a strut 43.

In order to convert the unwinding apparatus of FIG. 11 from the operative position to the transport position, the extensions 22, 24 of the arms 2, 3 of the transport device 35 are retracted and the arms 2, 3 are pivoted into parallel and/or side-by-side relationship to the strut 44. The handle 41 is then pivoted in a direction of arrow 45 until aligned with the strut 44 of the transport wheel 34. This intermediate position is shown in FIG. 13. Subsequently, the handle 41 is pushed inwards in the direction of arrow 51 into the strut 44 to realize the collapsed position, as shown in FIG. 14, so that the unwinding apparatus can now easily and comfortably transported.

Figure 12:
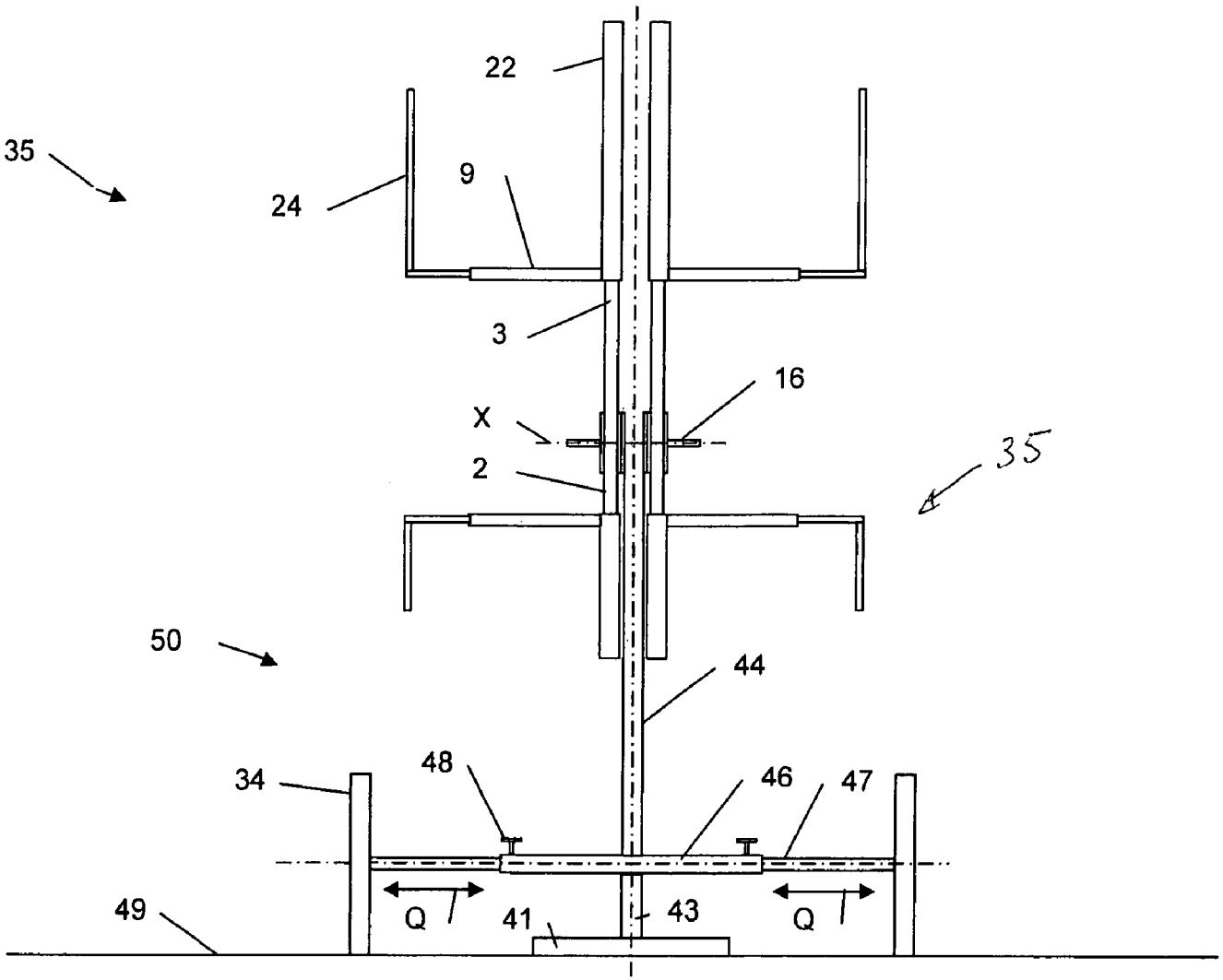
FIG. 12 is a frontal view of the unwinding apparatus of FIG. 11 provided with two coil holding devices.

FIG. 12 shows a frontal view of a variation of the unwinding apparatus of FIG. 11 which is provided here with two coil holding devices 35. The two transport wheels 34 of the stand 50 are interconnected by a telescopic axle assembly 47, received in a receptacle 46. The axles of the axle assembly 47 can be moved in and out of the receptacle 46, as indicated by double arrows Q, and secured in place by respective screw fasteners 48.

An unwinding apparatus according to the present invention can be converted between operative and transport positions with few manipulations and without need for additional tools. As a result of the collapsed configuration in the transport position, costs for storage and shipment are low. The unwinding apparatus is wear-resistant, requires little maintenance and is resistant to moisture and contaminants. Suitably, all hinged connection of the components can be fixed in place in a force-locking and/or form-fitting manner in the operative and transport positions or any intermediate position. Likewise, all telescopic extensions can be fixed in place in a force-locking and/or form-fitting manner in the operative and transport positions or any intermediate position.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. An unwinding apparatus for reeling off coiled material, comprising:

a coil holding device for supporting coiled material, said coil holding device including a plurality of spaced-apart arms extending radially in a plane, with at least one of the arms swingably mounted with respect to the other arms in the plane between an operative position and a transport position in which the least one of the arms extends parallel to a neighboring one of the arms, wherein at least one of the arms has a telescopic construction to allow adjustment to a width of the coiled material, and a centering pin swingably mounted to at least one of the arms for movement between an operative position, in which the centering pin extends perpendicular to the plane of the arms, and a transport position, in which the centering pin extends in parallel relationship to said arm, wherein the centering pin defines an axis and is constructed for telescoping in a direction of the axis in the operative position to allow adjustment to a height of the coiled material, and wherein the centering pin is secured to a telescopically movable extension in surrounding relationship to the telescopic arm; and a stand rotatably connected to the coil holding device and having a plurality of spaced-apart arms which extend radially in a plane, with at least one of the arms of the stand being swingably mounted in the plane between an operative position and a transport position in which the least one of the arms of the stand extends parallel to a neighboring one of the arms of the stand.

2. The unwinding apparatus of claim 1, wherein the centering pin is secured to the at least one of the arms of the coil holding device for displacement along the at least one of the arms.

3. The unwinding apparatus of claim 1, and further comprising a connection unit for rotatably joining the coil holding device with the stand; and a force application unit for applying at least one of a radial force and an axial force upon the connection unit to brake a rotation movement of the coil holding device in relation to the stand.

4. The unwinding apparatus of claim 1, wherein the stand has a plurality of radially extending spaced-apart arms and plural footings secured to an underside of the arms and having a vertical height which is at least as high as the coiled material loaded onto the coil holding device.

5. The unwinding apparatus of claim 4, wherein the footings are rotatably mounted to the arms of the stand.

6. The unwinding apparatus of claim 4, wherein at least one of the footings is constructed as a transport wheel.

7. The unwinding apparatus of claim 1, wherein each of the arms of the stand has a telescopic construction.

8. The unwinding apparatus of claim 1, wherein the centering pin has an extension piece movably received in the centering pin to provide the telescopic construction, said extension piece having an angled end portion which is rotatable about the axis of the centering pin.

9. The unwinding apparatus of claim 1, wherein the centering pin has an angled free end.

10. The unwinding apparatus of claim 1, and further comprising fixing means for securing a rotational position of the coil holding device in a force-locking and/or form-fitting manner in relation to the stand, when the coil holding device is in the transport position.

11. The unwinding apparatus of claim 1, wherein the coil holding device is constructed to form a unitary structure which holds the arms and the centering pin captive.

12. The unwinding apparatus of claim 1, wherein at least one of the arms of the stand has a telescopic construction.

13. The unwinding apparatus of claim 1, wherein two of the spaced-apart arms of the coil holding device extend in opposite directions and are rigidly fixed with respect to each other.

14. The unwinding apparatus of claim 1, wherein two of the spaced-apart arms of the coil holding device extend in opposite directions and are aligned in fixed relationship to each other by stops.

* * * * *